US007228686B2

(12) United States Patent
Royal et al.

(10) Patent No.: US 7,228,686 B2
(45) Date of Patent: Jun. 12, 2007

(54) CRYOGENIC REFRIGERATION SYSTEM FOR SUPERCONDUCTING DEVICES

(75) Inventors: John Henri Royal, Grand Island, NY (US); Richard C. Fitzgerald, Grand Island, NY (US); Norm Henry White, Tonawanda, NY (US); Jalal Hunain Zia, Grand Island, NY (US); M. Mushtaq Ahmed, Pittsford, NY (US)

(73) Assignee: Praxair Technology, Inc., Danbury, CT (US)

( * ) Notice: Subject to any disclaimer, the term of this patent is extended or adjusted under 35 U.S.C. 154(b) by 0 days.

(21) Appl. No.: 11/188,633

(22) Filed: Jul. 26, 2005

(65) Prior Publication Data

US 2007/0028636 A1 Feb. 8, 2007

(51) Int. Cl.
*F25B 9/00* (2006.01)

(52) U.S. Cl. ..... 62/6

(58) Field of Classification Search ..... 62/6, 62/51.1, 467, 513, 259.2
See application file for complete search history.

(56) References Cited

U.S. PATENT DOCUMENTS 4,884,409 A 12/1989 Quack et al. ..... 62/51.1
5,513,498 A 5/1996 Ackermann et al. ..... 62/51.1
5,848,532 A 12/1998 Gamble et al. ..... 62/48.2
6,347,522 B1 2/2002 Maguire et al. ..... 62/6
6,376,943 B1 4/2002 Gamble et al. ..... 310/52
6,415,613 B1 7/2002 Ackermann et al. ..... 62/51.1
6,415,628 B1 * 7/2002 Ahmed et al. ..... 62/534
6,425,250 B1 * 7/2002 Acharya et al. ..... 62/6
6,438,969 B1 8/2002 Laskaris et al. ..... 62/51.1
6,442,949 B1 9/2002 Laskaris et al. ..... 62/51.1
6,553,773 B2 4/2003 Laskaris ..... 62/64
6,625,992 B2 9/2003 Maguire et al. ..... 62/6
6,640,552 B1 11/2003 Rampersad et al. ..... 62/6
6,640,557 B1 11/2003 Arman et al. ..... 62/50.7
6,644,038 B1 11/2003 Acharya et al. ..... 62/6
6,725,683 B1 4/2004 Laskaris ..... 62/259.2
6,732,536 B1 5/2004 Bonaquist et al. ..... 62/50.5
6,895,765 B2 5/2005 Bonaquist et al. ..... 62/50.5

* cited by examiner

*Primary Examiner*—Melvin Jones
(74) *Attorney, Agent, or Firm*—David M. Rosenblum

(57) ABSTRACT

A system for cooling one or more discrete superconducting devices wherein a primary refrigerator subcools cryogenic liquid for desubcooling in the devices and subsequently resubcools this liquid in a recirculation loop, and additional cryogenic liquid is maintained in a subcooled condition within a reserve storage container by diversion of some of the refrigeration generated by the primary refrigerator into the reserve storage container.

17 Claims, 2 Drawing Sheets

CRYOGENIC REFRIGERATION SYSTEM FOR SUPERCONDUCTING DEVICES

TECHNICAL FIELD

This invention relates generally to the provision of cooling or refrigeration to one or more superconducting devices.

BACKGROUND ART

Superconductivity is the phenomenon wherein certain metals, alloys and compounds, such as YBCO, REBCO and BSCCO, at very low temperatures lose electrical resistance so that they have infinite electrical conductivity. It is important in the use of superconducting devices that the cooling, i.e. refrigeration, provided to the superconducting device not fall below a certain level lest the wire lose its ability to superconduct and the function of the device be compromised. Often this refrigeration is supplied by a cryogenic liquid and consumed in the device by warming of the liquid. Most devices will not tolerate a gas phase of the coolant due to electrical considerations.

SUMMARY OF THE INVENTION

One aspect of the invention is:

A method for providing refrigeration to a superconducting device comprising:

(A) using refrigeration generated by a primary refrigerator to cool cryogenic liquid, and passing the cooled cryogenic liquid to at least one superconducting device to provide cooling to the superconducting device;

(B) using refrigeration generated by the primary refrigerator to subcool cryogenic liquid, passing the subcooled cryogenic liquid to a reserve storage container, and maintaining the liquid within the reserve storage container in a subcooled condition; and (C) passing subcooled liquid from the reserve storage container to the superconducting device to provide cooling to the superconducting device.

Another aspect of the invention is:

Apparatus for providing refrigeration to a superconducting device comprising:

(A) a primary refrigerator, at least one superconducting device, and means for passing cryogenic liquid from the primary refrigerator to the superconducting device;

(B) a reserve storage container, and means for passing cryogenic liquid from the primary refrigerator to the reserve storage container; and (C) means for passing cryogenic liquid from the reserve storage container to the superconducting device.

As used herein the term "cryogenic temperature" means a temperature at or below 120 K As used herein the term "cryocooler" means a refrigerating machine able to achieve and maintain cryogenic temperatures.

As used herein the term "superconductor" means a material that loses all of its resistance to the conduction of an electrical current once the material attains some cryogenic temperature.

As used herein the term "refrigeration" means the capability to reject heat from a subambient temperature entity.

As used herein the term "indirect heat exchange" means the bringing of entities into heat exchange relation without any physical contact or intermixing of the entities with each other.

As used herein the term "subcool" means to cool a liquid to be at a temperature lower than the saturation temperature of that liquid for the existing pressure.

As used herein the term "direct heat exchange" means the transfer of refrigeration through contact of cooling and heating entities.

As used herein the term "superconducting device" means a device that utilizes superconductor material, for example, as a high temperature or low temperature superconducting cable or in the form of wire for the coils of a rotor for a generator or motor, or for the coils of a magnet or transformer.

Figure 1:
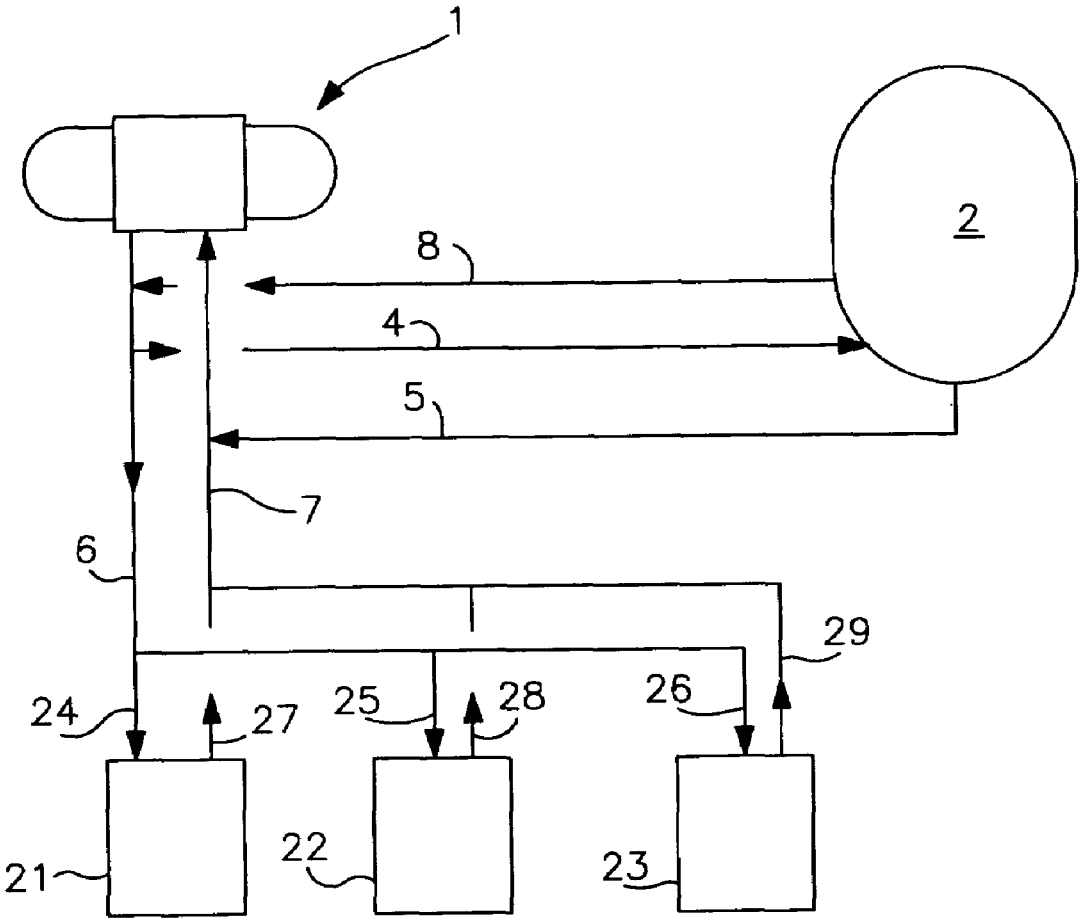
FIG. 1 is a schematic representation of one preferred embodiment of the cryogenic superconductor cooling system of the invention.

The numerals in the Drawings are the same for the common elements.

DETAILED DESCRIPTION

The invention will be described in greater detail with reference to the Drawings. Referring now to FIG. 1, there is shown primary refrigerator 1 which generates refrigeration which cools cryogenic liquid for passage to one or more superconducting devices.

Primary refrigerator 1 is preferably a cryocooler. Any suitable cryocooler may be used in the practice of this invention. Among such cryocoolers one can name Stirling cryocoolers, Gifford-McMahon cryocoolers and pulse tube refrigerators. A pulse tube refrigerator is a closed refrigeration system that oscillates a working gas in a closed cycle and in so doing transfers a heat load from a cold section to a hot section. The frequency and phasing of the oscillations is determined by the configuration of the system. The driver or pressure wave generator may be a piston or some other mechanical compression device, or an acoustic or thermoacoustic wave generation device, or any other suitable device for providing a pulse or compression wave to a working gas. That is, the pressure wave generator delivers energy to the working gas within the pulse tube causing pressure and velocity oscillations. Helium is the preferred working gas; however any effective working gas may be used in the pulse tube refrigerator and among such one can name nitrogen, oxygen, argon and neon or mixtures containing one or more thereof such as air.

The oscillating working gas is preferably cooled in an aftercooler and then in a regenerator as it moves toward the cold end. The geometry and pulsing configuration of the pulse tube refrigeration system is such that the oscillating working gas in the cold head expands for some fraction of the pulsing cycle and heat is absorbed by the working gas by indirect heat exchange which provides refrigeration to the cryogenic liquid. Preferably the pulse tube refrigeration system employs an inertance tube and reservoir to maintain the gas displacement and pressure pulses in appropriate phases. The size of the reservoir is sufficiently large so that essentially very little pressure oscillation occurs in it during the oscillating flow.

The cryocooler components include the mechanical compression equipment (pressure wave generator), the inertance tube and reservoir, the final heat rejection system and the electrical components required to drive and control the cryocooler. Electrical energy is primarily converted into acoustic energy in the pressure wave generator. This acoustic energy is transferred by the oscillating working gas to the cold head via a transfer tube. The transfer tube connects the pressure wave generator to the aftercooler located at the warm end of the cold head where heat is removed as previously described.

Cryogenic liquid, which has been subcooled by the refrigeration generated by primary refrigerator 1, is passed in line 6 to one or more superconducting devices, shown in representative form in FIG. 1 as items 21, 22 and 23 having input lines 24, 25 and 26 respectively. Among the cryogenic liquids which may be used in the practice of this invention one can name liquid nitrogen, liquid helium, liquid argon, and liquid neon, as well as mixtures comprising one or more of these liquids.

Examples of superconducting devices which may be used in the practice of this invention include transformers, generators, motors, fault current controllers/limiters, electronics/cellphone transmitters, high temperature or low temperature superconducting cables, infrared sensors, superconducting magnetic energy storage systems, and magnets such as would be used in magnetic resonance imaging systems or other industrial applications. When a plurality of superconducting devices receive cooling from the cryogenic liquid, the devices could be all the same type of device or two or more of the devices could be different types of devices. Moreover, the devices could be connected in a functional or other manner and also could be part of a facility such as a superconducting or super substation.

After providing cooling to the superconducting device(s) the now desubcooled cryogenic liquid is returned to the primary refrigerator in a return loop where it is resubcooled and passed again to the superconducting device(s). In the embodiment of the invention illustrated in FIG. 1 the return loop comprises output lines 27, 28 and 29, respectively from superconducting devices 21, 22 and 23, which each feed into line 7 for return to primary refrigerator 1.

Over time, cryogenic liquid recirculating between the primary refrigerator and the superconducting device(s) will need replenishment due to vaporization losses. Such replenishment will come from cryogenic liquid stored in reserve storage container 2. Cryogenic liquid from reserve storage container 2 will also be provided to the superconducting device(s) in the event of failure or other shutdown of the primary refrigerator.

When cryogenic liquid is provided from reserve storage container 2 to the superconducting device(s) it is imperative that the cryogenic liquid be in a subcooled condition to ensure an adequate amount of cooling for the superconducting device(s) and to ensure against the formation of any gas within the devices. In the practice of this invention the cryogenic liquid within the reserve storage container is maintained in a subcooled condition. Cryogenic liquid, which has been subcooled by refrigeration generated by primary refrigerator 1, is passed into reserve storage container 2, such as through line 4 which branches from line 6. Simultaneously, some cryogenic liquid from reserve storage container 2 is passed to primary refrigerator 1 to pick up more subcooling, such as through line 5 which connects to line 7. In this way the content of reserve storage container 2 is maintained in a subcooled condition. When necessary, subcooled cryogenic liquid from reserve storage container 2 is passed to the superconducting device(s) to provide cooling to the superconducting devices(s), such as through line 8 which connects to line 6. The passage of subcooled cryogenic liquid from the reserve storage container to the superconducting device(s) can occur during the passage of subcooled cryogenic liquid from the primary refrigerator to the superconducting device(s), for at least a part of the time, and/or may occur after such passage. Indeed the passage of subcooled cryogenic liquid from the reserve storage container to the superconducting device(s) can occur prior to the passage of the cryogenic liquid from the primary refrigerator to the superconducting device(s), such as during startup of the system.

Figure 2:
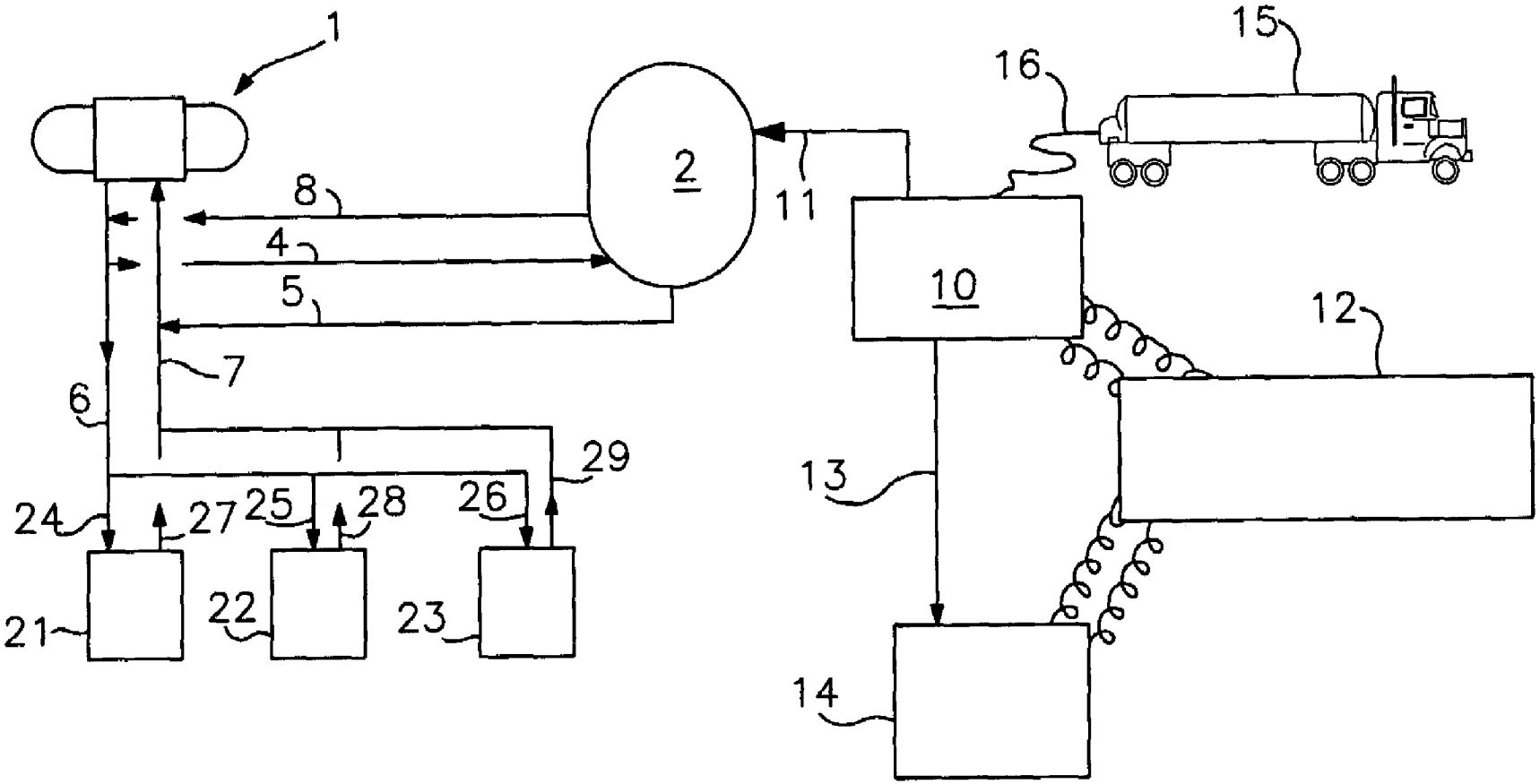
FIG. 2 is a schematic representation of an embodiment of the cryogenic superconductor cooling system of the invention showing one delivery option for the cryogenic liquid.

From time to time the cryogenic liquid within the reserve storage container is replenished. FIG. 2 illustrates one replenishment arrangement wherein replenishment cryogenic liquid is provided from tanker truck 15. Preferably the replenishment cryogenic liquid is subcooled prior to being passed into the reserve storage container. In the embodiment illustrated in FIG. 2, cryogenic liquid from tanker truck 15 is passed in fill line 16 to auxiliary refrigerator 10 wherein it is subcooled, and from there is passed in line 11 into reserve storage container 2. Auxiliary refrigerator 10 is powered by auxiliary power supply 12. Preferably auxiliary refrigerator 10 comprises a vacuum pumping system as this appreciably reduces the scale of the needed auxiliary energy supply. Moreover, as illustrated in FIG. 2, where the cryogenic liquid is liquid hydrogen, hydrogen gas vented from the vacuum pumped refrigerator may be passed in line 13 to fuel cell 14 to power the fuel cell, the output of which can drive the vacuum pump's motor. Alternatively, cryogenic liquid may be passed from the tanker truck to the reserve storage container without subcooling so that all of the subcooling is done by the primary refrigerator, or the cryogenic liquid from the tanker truck may be subcooled by a portable truck mounted auxiliary refrigerator prior to being passed into the reserve storage container.

Although the invention has been described in detail with reference to certain preferred embodiments, those skilled in the art will recognize that there are other embodiments of the invention within the spirit and the scope of the claims.

The invention claimed is:

1. A method for providing refrigeration to a superconducting device comprising:

(A) using refrigeration generated by a primary refrigerator to cool cryogenic liquid, and passing the cooled cryogenic liquid to at least one superconducting device to provide cooling to the superconducting device;

(B) using refrigeration generated by the primary refrigerator to subcool cryogenic liquid, passing the subcooled cryogenic liquid to a reserve storage container, and maintaining the liquid within the reserve storage container in a subcooled condition;

(C) passing subcooled liquid from the reserve storage container to the superconducting device to provide cooling to the superconducting device either simultaneously with step (A), or after step (A), or prior to step A.

2. The method of claim 1 wherein the cryogenic liquid from the primary refrigerator is passed to a plurarity of discrete superconducting devices.

3. The method of claim 2 wherein the superconducting devices are all of the same type.

4. The method of claim 2 wherein the superconducting devices are not all the same type.

5. The method of claim 2 wherein the superconducting devices comprise a superconducting substation.

6. The method of claim 1 wherein the cryogenic liquid comprises at least one of liquid nitrogen, liquid helium, liquid argon, and liquid neon.

7. The method of claim 1 further comprising passing cryogenic liquid from a tanker truck into the reserve storage container.

8. The method of claim 7 wherein the cryogenic liquid from the tanker truck is subcooled prior to being passed into the reserve storage container.

9. Apparatus for providing refrigeration to a superconducting device comprising:

(A) a primary refrigerator, at least one superconducting device, and means for passing cryogenic liquid from the primary refrigerator to the superconducting device;

(B) a reserve storage container, and means for passing cryogenic liquid from the primary refrigerator to the reserve storage container; and (C) means for passing cryogenic liquid from the reserve storage container to the superconducting device.

10. The apparatus of claim 9 wherein the primary refrigerator is a cryocooler.

11. The apparatus of claim 10 wherein the cryocooler is a pulse tube refrigerator.

12. The apparatus of claim 9 further comprising an auxiliary refrigerator and means for passing subcooled cryogenic liquid from the auxiliary refrigerator into the reserve storage container.

13. The apparatus of claim 12 further comprising a fuel cell and means for passing fluid from the auxiliary refrigerator to the fuel cell.

14. The apparatus of claim 9 comprising a plurality of superconducting devices for receiving cryogenic liquid from the primary refrigerator and from the reserve storage container.

15. The apparatus of claim 14 wherein the superconducting devices are all of the same type.

16. The apparatus of claim 14 wherein the superconducting devices are not all of the same type.

17. The apparatus of claim 14 wherein the superconducting devices comprise a superconducting substation.

* * * * *